United States Patent [19]

Gordon, Jr. et al.

[11] Patent Number: 4,906,026

[45] Date of Patent: Mar. 6, 1990

[54] SUBLIMINAL CHECKBOOK SYSTEM

[75] Inventors: Melvin T. Gordon, Jr., Lawrenceville; Raju Venkatapathy, Roswell, both of Ga.

[73] Assignee: Image/Chek Corporation, Roswell, Ga.

[21] Appl. No.: 310,956

[22] Filed: Feb. 16, 1989

[51] Int. Cl.[4] ..... B42D 15/02

[52] U.S. Cl. ..... 283/67; 283/52; 283/52.1; 283/56; 283/58; D19/11

[58] Field of Search ..... 283/67, 51, 52, 52.1, 283/56, 57, 58, 59; 282/23 R; D19/11

[56] References Cited

U.S. PATENT DOCUMENTS

| | | | |
|---|---|---|---|
| 563,700 | 7/1896 | White | 283/57 |
| 714,920 | 12/1902 | Kuehn | 283/59 |
| 752,520 | 2/1904 | Clements | 283/59 |
| 1,315,591 | 9/1919 | Barker | 283/57 |
| 2,310,332 | 2/1943 | Wilbanks | 283/58 |
| 3,790,193 | 2/1972 | McBride | 283/57 |
| 4,722,554 | 2/1988 | Pettit | 283/56 |

*Primary Examiner*—Frank T. Yost
*Assistant Examiner*—Y. Lin
*Attorney, Agent, or Firm*—James A. Hinkle

[57] ABSTRACT

A pad of bank checks in which the check pad comprises multiple logos containing advertising coupons which are designed to be perforated for easy removal, and a series of bank checks each with a rotating advertising logo and/or slogan matching the sequential representation of the coupons.

6 Claims, 2 Drawing Sheets

SUBLIMINAL CHECKBOOK SYSTEM

BACKGROUND OF THE INVENTION

1. Field of the Invention

The present invention relates generally to a means and method for advertising, and more particularly to a means for effectively advertising in a checkbook.

2. Description of the Prior Art

A typical, personal checkbook consists of a printed order of personal checks for the consumer by a bank printer which generally comprises of a pad of checks, along with a supply of deposit slips in the rear of the pad. The very first page of the first pad of checks normally has a sheet requesting that the consumer review the checks carefully for errors and ommissions, and the subsequent pads of checks, in the same order, are usually manufactured in such a manner as to show the next succeeding check as a first item of the pad.

It has been common in the past to advertise certain products, services or organizations upon each individual check if the consumer so desired. It has been common to put fanciful designs on the consumers' check if that was desired.

However, the concept of coupling an advertising message on the individual checks with a coupon bound with the check pad has heretofore not been known.

SUMMARY OF THE INVENTION

It is, theefore, an object of the present invention to provide an advertising system of unique design with personal and business checkbooks.

It is yet another object of this invention to provide a check-sized sheet or sheets with multiple perforated coupons bound into each of the check pads in the same manner as the checks, and to position said coupons just prior to the first check of each pad.

Another object of the invention is to provide permanently bound, perforated coupons in a check pad with the checks wherein the coupons will be directly related to a series of checks which are correlated with the coupons throughout the check pad. It is anticipated that the number of designs and the number of check-sized sheets would be directly related to each other.

Other objects, advantages, and capabilities of the invention will become apparent from the following description, taken in conjunction with the accompanying drawings, showing only a preferred embodiment of the invention.

DESCRIPTION OF THE PREFERRED EMBODIMENT

Figure 1:
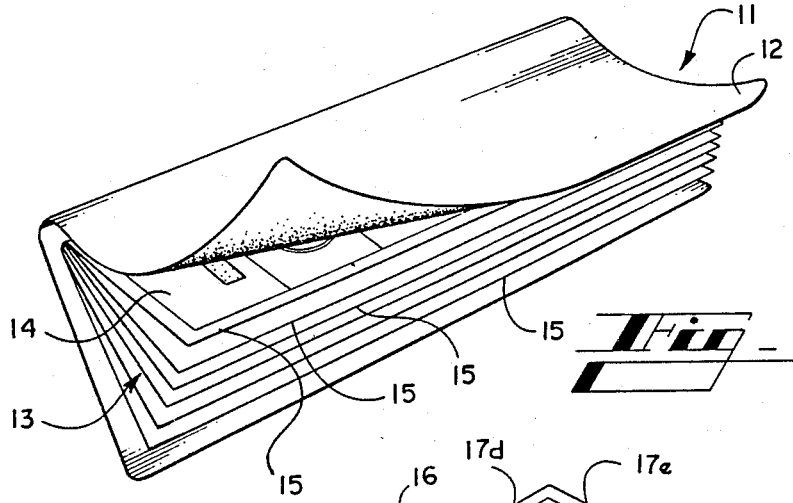
FIG. 1 is an overall perspective view of a typical checkbook showing an outside cover and the inside printed pad of advertising coupons and checks as contemplated by the present invention.

Referring to the drawings wherein like numerals designate corresponding parts throughout the several figures, the checkbook contemplated by the present invention is generally indicated by the numeral 11. Comprising the checkbook 11 is a typical outside cover 12 which is designed to encompass and hold for use, a pad of checks and advertising coupons generally indicated by the numeral 13.

The check pad and coupons 13 generally comprises a sheet of perforated coupons 14 which typically would be the first sheet of a checkbook pad after which a series of checks and/or deposit tickets, indicated by numeral 15, would be bound with and stacked directly underneath the coupon page 14.

The coupon page 14 is anticipated to be a check-sized sheet with multiple perforations 16 to separate the individual tearout coupons 14*a*, 14*b*, 14*c*, 14*d* and 14*e*. The perforations of the coupon allow for easy removal of the coupons from the page for use by the ultimate consumer. It is anticipated that each coupon would have an individual advertising logo and/or slogan which would allow the customer to utilize the coupon to receive a certain "savings" offered by the advertiser. In addition, each coupon would have a relationship to an individual check 15 in each check pad which allows the advertising logo and/or slogan to be imprinted upon an individual check in the same relationship within the check pad as the coupons bear to one another on the coupon page 14.

Figure 2:
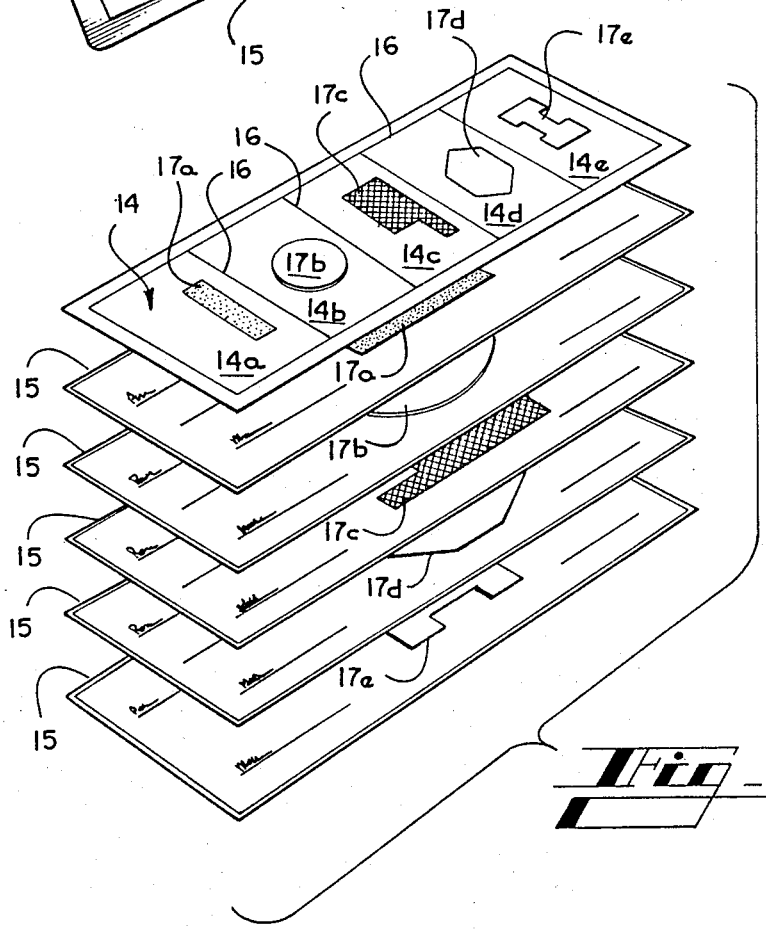
FIG. 2 is an exploded perspective view showing the relationship of the advertising coupons and the checks contemplated by the present invention.

Therefore, if on the coupon page 14 the advertiser had a particular logo, for instance as indicated by the symbols 17*a*, 17*b*, 17*c*, 17*d* and 17*e*, then these representative logos could be printed on the checks in the same sequence as found on the coupon page, as more easily seen in FIG. 2. While the present invention has shown a system for utilizing five (5) coupons and a rotating sequencial design of checks matching those five (5) coupons, it is obvious that the number of coupons and sequencial checks could be of virtually any number, and the coupons may be printed on a sheet in a different manner for the ease of the customer rather than that showed in the preferred embodiment of the drawings.

Figure 3:
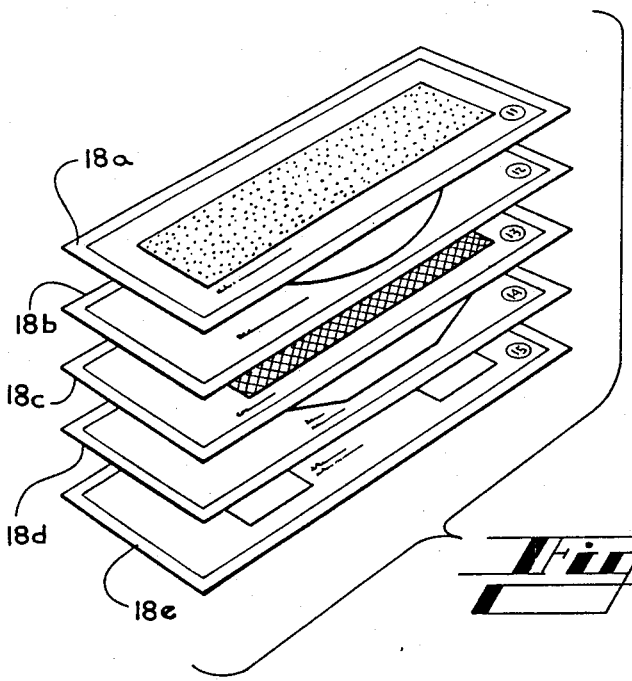
FIG. 3 is an exploded perspective view of another embodiment of the invention showing a pad of advertising coupons.
Figure 4:
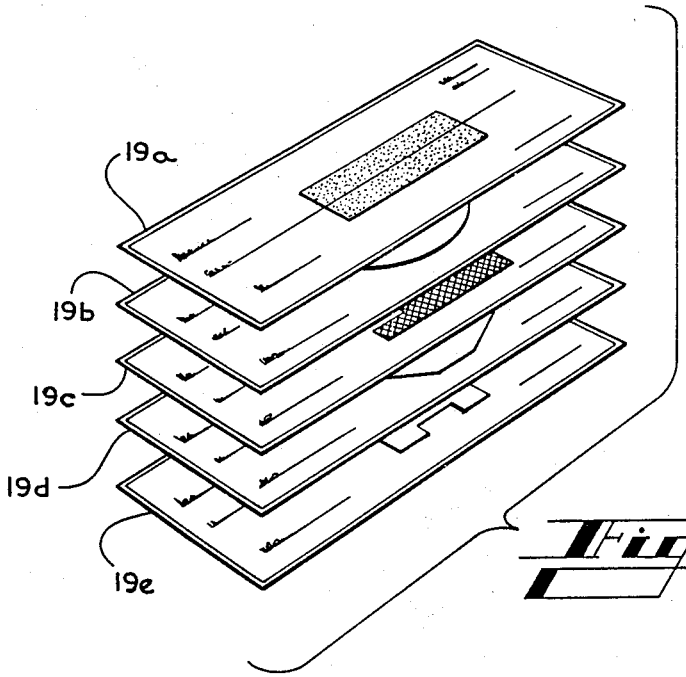
FIG. 4 is an exploded perspective view of a pad of checks which are adapted to be padded with the coupons of FIG. 3.

In a second embodiment of the invention, as shown in FIG. 3, it is anticipated that a full pad of coupons 18*a*—*e* may be padded together and that a full pad of checks 19*a*—*e* may also be padded together, as shown in FIG. 4. The pads of FIGS. 3 and 4 would then be joined together into a unitary checkbook. In the manner described for the embodiment of FIGS. 1 and 2, the individual coupons, here shown full page size, bear a sequencial relationship to the checks of FIG. 4. As is shown, for instance, coupons 18*a* bears an advertising logo that matches the logo printed on check 19*a*. The remaining coupons 18*b*—*e* respectively match the logos upon checks 19*b*—*e*.

It may be that an advertiser may find it desirable to vary the format of FIGS. 3 and 4 by interleaving one advertising coupon with each check. For instance it might be that in padding the coupons and checks, the manufacturer may place coupon 18*a* atop check 19*a*, then coupon 18*b* atop check 19*b* and so forth. As long as a coupon with its logo matches a particular check with its logo the concept of the present invention is present.

It is believed that the present invention defines a means and method of advertising not heretofore known, and one which will find great acceptance throughout the banking and advertising industry and one which will allow an advertising message to be disseminated to the public by new and novel means and to be of benefit to the consuming public and the advertising media. It is evident that the advertising message is always before the customer when the customer is using the checkbook, and since the checkbook is typically used for paying the customer's bills and other expenses, the customer will always have the coupon and advertising message in the forefront and the customer will be more likely to utilize the coupons in this manner then in current methods of coupon distribution.

Various modifications may be made of the invention without departing from the scope thereof, and it is desired therefore, that only such limitations shall be placed thereon as are imposed by the prior art and which are set forth in the appended claims.

What is claimed is:

1. A checkbook system comprising:

a plurality of pages stacked one upon the other, one edge of each of the pages being aligned with one edge of each of the other pages, the stacked pages being divided into multiple sections each of which have at least one page, at least one section being printed with advertising indicia, at least one other section having the advertising indicia of the other printed thereon and further having printed thereon indicia denominating a bank draft, wherein the one of said sections of stacked pages has a plurality of pages each of which bear individual advertising indicia differing one from the other, the other of said sections of stacked pages having a plurality of pages each of which bear individual advertising indicia differing one from the other.

2. The checkbook system as claimed in claim 1, wherein the pages of the first section are interleaved with the pages of the second section sequentially so that the advertising indicia of the first and second sections match one another.

3. A checkbook system comprising:

a plurality of pages stacked one upon the other, one edge of each of the pages being aligned with one edge of each of the other pages, the stacked pages being divided into at least two sections, one section having at least one topmost page, a second section having a plurality of pages, the topmost page of the first section of the stacked pages having a plurality of perforations defining discrete areas adapted to be individually disengaged from the topmost page, the discrete areas having sequentially printed advertising indicia printed thereon, the pages of the second section of the stacked pages being sequentially printed with advertising indicia and having printed thereon indicia denominating a bank draft.

4. The checkbook system as claimed in claims 3, wherein the advertising indicia sequentially printed on the pages of the second section corresponds to the same sequential printing of the advertising indicia of the topmost page of the first section of stacked pages.

5. The checkbook system as claimed in claim 4, wherein the aligned edges of the stacked pages are secured one to the other.

6. A method of presenting a subliminal advertising message comprising the steps of:

stacking a plurality of printed pages one upon the other, aligning one edge of each of the pages with one edge of the remainder of the pages, securing the aligned edges one to the other, dividing the stacked pages into multiple sections each of which have at least one page, providing the topmost page of a first section with advertising indicia, providing a second section with the advertising indicia of the first section printed thereon, dividing the stacked pages into at least two sections with a first section having at least one topmost page and a second section having a plurality of pages, providing the topmost page of the first section with a plurality of perforations defining discrete areas adapted to be individually disengaged from the topmost page, printing the discrete areas of the topmost page with advertising indicia, sequentially printing the pages of the second section of the stacked pages with advertising indicia corresponding to the advertising indicia of the topmost page and having printed thereon indicia denominating a bank draft.

* * * * *